United States Patent [19]

Hankins

[11] 4,062,544

[45] Dec. 13, 1977

[54] BOARD GAME UTILIZING OWNER OPERATED BUSINESSES

[76] Inventor: Anthony Hankins, 1207C Solano, Albany, Calif. 94706

[21] Appl. No.: 633,912

[22] Filed: Nov. 20, 1975

[51] Int. Cl.[2] ..... A63F 3/00

[52] U.S. Cl. ..... 273/134 AF; 273/134 C; 273/134 D

[58] Field of Search ..... 273/134

[56] References Cited

U.S. PATENT DOCUMENTS 3,163,423 12/1964 Jackson ..... 273/134 AF

*Primary Examiner*—Richard C. Pinkham
*Assistant Examiner*—Harry G. Strappello
*Attorney, Agent, or Firm*—Bruce & McCoy

[57] ABSTRACT

A board game which utilizes owner operated businesses to maximize a player's financial worth at the expense of opponent players comprised of apparatus for identifying each player by a fictitious name prior to commencing play, tokens for each player, bogus money, and a game board having a continuous play field divided into play spaces wherein the play spaces include spaces representing businesses identified by the fictitious name to a particular player which are subject to acquisition and operation by the player so identified as against opponent players, and businesses not identified to any particular player subject to acquisition and operation by any of the players as against opponent players. Also provided is a chance device for advancing the player tokens around the play field of the game board.

5 Claims, 1 Drawing Figure

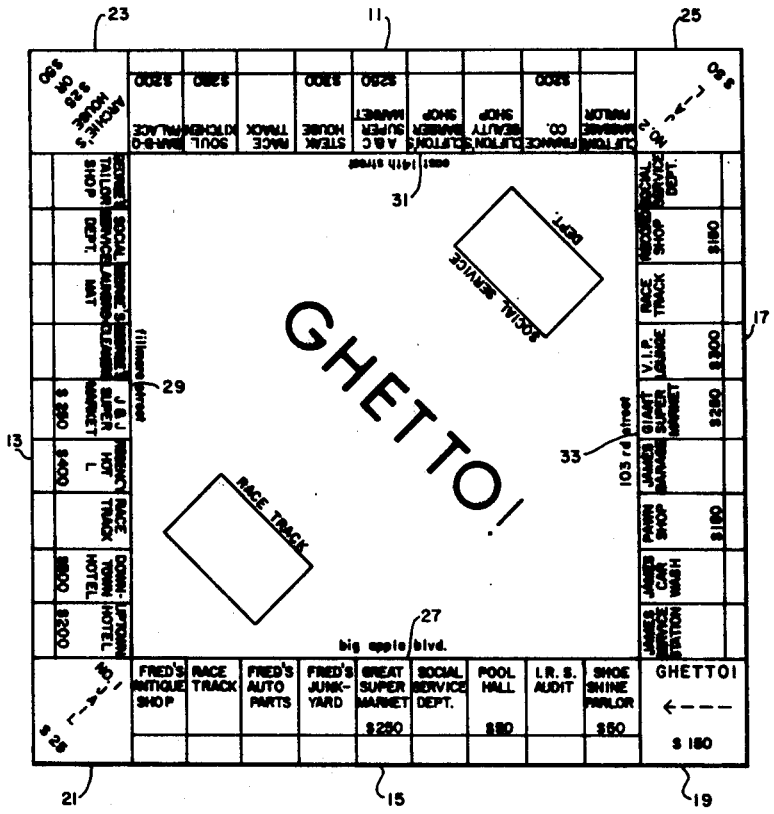

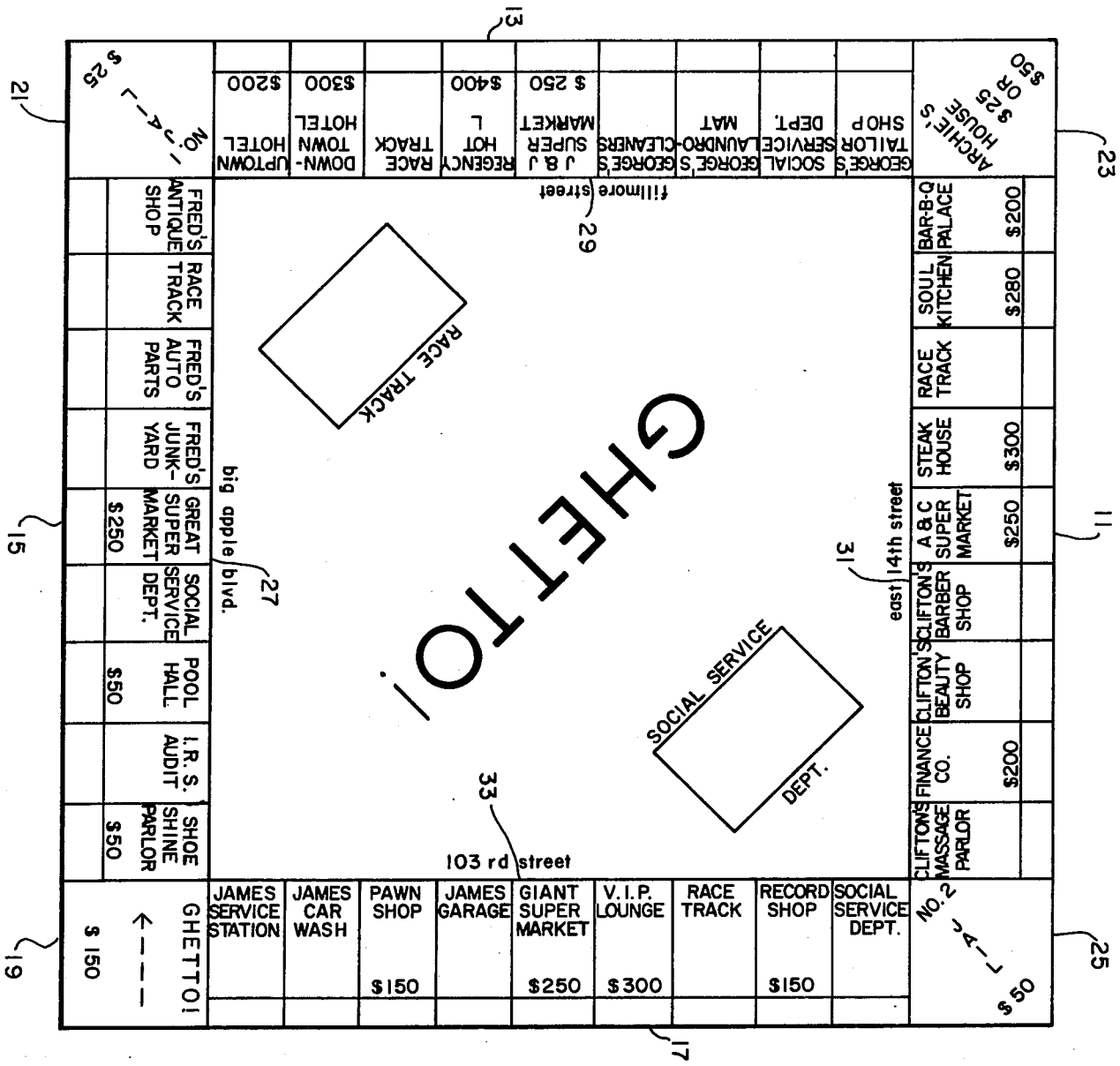
GHETTO!
SOCIAL SERVICE DEPT.
RACE TRACK
fillmore street
103 rd street
big apple blvd.
east 14th street
GEORGE'S TAILOR SHOP
SOCIAL SERVICE DEPT.
GEORGE'S LAUNDRO-MAT
GEORGE'S CLEANERS
J & J SUPER MARKET $ 250
REGENCY HOTEL $400
RACE TRACK
DOWN-TOWN HOTEL $300
UPTOWN HOTEL $200
NO. 1 $25
FRED'S ANTIQUE SHOP
RACE TRACK
FRED'S AUTO PARTS
FRED'S JUNK-YARD
GREAT SUPER MARKET $250
SOCIAL SERVICE DEPT.
POOL HALL $50
I. R. S. AUDIT
SHOE SHINE PARLOR $50
GHETTO! ← $ 150
JAMES SERVICE STATION
JAMES CAR WASH
PAWN SHOP $150
JAMES GARAGE
GIANT SUPER MARKET $250
V.I.P. LOUNGE $300
RACE TRACK
RECORD SHOP $150
SOCIAL SERVICE DEPT.
NO. 2 $50
CLIFTON'S MASSAGE PARLOR
CLIFTON'S FINANCE CO. $200
CLIFTON'S BEAUTY SHOP
CLIFTON'S BARBER SHOP
A & C SUPER MARKET $250
STEAK HOUSE $300
RACE TRACK
SOUL KITCHEN $280
BAR-B-Q PALACE $200
ARCHIE'S HOUSE $25 OR $50
11
13
15
17
19
21
23
25
27
29
31
33

BOARD GAME UTILIZING OWNER OPERATED BUSINESSES

FIELD OF THE INVENTION

The present invention relates to games generally and more particularly to a board game utilizing owner operated businesses which can be acquired by the players of the game who then operate the businesses as against opponent players.

The game of the present invention is preferrably called GHETTO to designate that each player begins play with no money or financial means, or in other words that he starts in the "ghetto". The overall strategy of the game is for each player to raise himself out of the ghetto, acquire and operate business properties as against opponent players and thereby maximize his financial worth. The richest player at the end of the game wins.

SUMMARY OF THE INVENTION

The present invention is a board game wherein businesses are subject to acquisition by the players of the game who can then operate the businesses as against opponent players to improve the owner operator's financial condition. The board game is comprised of means for identifying each player by a fictitious name prior to commencing play, tokens for each identified player, and bogus money which can be used for acquiring businesses or paying for services or the like. Also provided is a game board having a plurality of contiguous play spaces disposed generally around the perimeter of the board so as to define a continuous play field on which the tokens can be moved. Certain of the play spaces in the play field designate businesses which are identified to a particular player by that player's fictitious name. These player identified businesses are subject to acquisition only by the player so identified. A player-identified business is acquired by the identified player at no cost if the identified player chances to land on the play space designating the identified business.

In addition to the player identified businesses, certain play spaces in the play field designate businesses not identified to a particular player. These non-identified businesses are subject of acquisition at a predetermined price by any player who first chances to land on the play space so designating the non-identified business property.

Finally, chance means are provided for advancing the player tokens around the play field.

OBJECTS OF THE INVENTION

It is therefore an object of the present invention to provide a board game wherein designated businesses can be acquired and operated by the players as against opponent players.

It is another object of the present invention to provide a board game wherein players are identified to and have a pre-acquisition proprietary interest in particular business properties.

It is a further object of the present invention to provide a board game wherein the players begin in the "ghetto" with no property or financial means and thereafter strive to maximize their financial worth.

It is still another object of the present invention to provide a board game wherein a player can identify with the small struggling entrepeneur who may come from the ghetto.

It is still a further object of the present invention to provide a board game which is exciting to play for most age groups and which embraces contemporary places, businesses and social situations.

Other objects of the present invention will become apparent from the following description of the preferred embodiment.

DESCRIPTION OF THE DRAWINGS

The FIGURE of the drawings shows the game board of the present invention in its preferred embodiment.

DESCRIPTION OF THE PREFERRED EMBODIMENT

The board game of the present invention is essentially comprised of a means for identifying each player by a fictitious name prior to commencing play, tokens for each identified player, bogus money which can be used by each player for acquiring business property or paying for services of businesses owned by opponent players and for certain other aspects of the game, a game board having a play field, and a chance means for advancing the players' tokens around the play field on the game board. The game contemplates that each player will by chance attempt to acquire as many different business properties as he can in accordance with the rules of the game and operate these businesses as against opponent players. The opponent player is charged a service fee by the owner of the business when and if such opponent players's token lands on the play space representing the owner's business property. The goal is to become the richest player and thereby win the game.

Means for identifying each player preferrably includes cards which have a fictitious name imprinted on one side thereof; these cards can be color coded on the side of the fictitious name to correspond to color coding on the game board. The manner in which the fictitious names are correlated with and affect the business properties on the game board is more fully described hereinbelow. To commence play, the cards are placed face down and one card is drawn by each player so as to identify the player with the fictitious name on that card. The preferred embodiment described herein has a maximum of four players which are given fictitious names of Fred, George, Clifton, and James. It is understood of course that other names can be used. It is also noted that anywhere from two to four players can participate in the game.

The tokens provided to each player for moving on the game board are differentiated one from the other preferrably by shape or color. These tokens can be chosen by the players either before or after the drawing of identification cards.

Bogus money is provided in suitable denominations for transacting business in accordance with the rules of the game and in suitable quantities for continued play. Preferrably, denominations of $5, $10, $20, $50, $100 and $500 are provided with approximately 20 bills of each denomination.

The chance means for advancing the player tokens around the play field of the game board preferrably consists of a conventional pair of dice which are thrown in turn by each player to determine by chance the distance on the play field which that player shall move.

Referring to the FIGURE of the drawing, the game board is comprised of a plurality of contiguous play spaces disposed generally around the perimeter of the board so as to define a continuous play field. The board is substantially square wherein the play field extends in a straight path along each side 11, 13, 15, 17 of the square with each straight portion of the play field being designated as a street name, in this case, Big Apple Boulevard, Filmore Street, East 14th Street, and 103rd Street. The straight portions of the play field meet at corner squares 19, 21, 23, 25. Corner square 19 is designated ghetto and it is from here that the play begins; corner squares 21, 25 are designated Jail No. 1 and Jail No. 2, respectively, and corner square 23 is designated Archie's House with an indication of $25 or $50 dollars imprinted thereon. These corner squares are not subject to acquisition by any player but are utilized according to the rules of the game described below. Except for certain reserved play spaces, each of the play spaces in the straight portions or streets of the play field have imprinted thereon the name of a particular business such as, referring to the FIGURE, George's Laundromat, Downtown Hotel, Fred's Junkyard, James Carwash, and Steakhouse. It is noted that most of the business identified on the board would customarily be operated as sole proprietorships, the exceptions being supermarkets, 27, 29, 31, 33, located in the center of each street of the play field and the finance company. In any event the businesses and street names of the play field are chosen to reflect an inner city environment with corner square 19 representative of the ghetto from which each player strives to ascend.

The business properties on the four streets of the play field are essentially divided into two categories. The first category is comprised of play spaces which, in addition to the name of the business, have imprinted thereon one of the four available fictitious names for identifying a player; this associates that business to the player who chances to be identified with the fictitious name. Referring to the FIGURE, it is seen that each fictitious name and hence each of the four players has three businesses, and that each of these businesses is related in nature. For example, George has George's Tailor Shop, George's Laundromat, and George's Cleaners, a tailor shop, laundromat and cleaners all being related businesses. Each of these player identified businesses is subject to acquisition only by the player identified to that business if and when that player chances to land on the play space designating the business. There is no acquisition cost to the identified player and upon acquisition the identified player can operate the business as against opponent players.

The player identified businesses are grouped according to player such that the groupings for the different identified players appears on separate streets of the play field. These business properties are also preferrably color coded at the base portion thereof to correspond to the color coding on the player identification cards. It is understood that the businesses represented are a matter of choice only and that different businesses can be represented as well as different groupings used.

The second category of business properties is comprised of businesses not identified to any particular player; these businesses are subject to acquisition by any of the players of the game. As can be seen from the drawing, there is from three to five non-identified businesses on each street of the playing field, and each play space representing a non-identified business has imprinted on the bottom portion thereof an indication of acquisition price designating the price a player who first chances to land on such play space must pay in order to acquire that business property for operation as against opponent players. There is no requirement that a player acquire an available business should he land on the play space. The acquisition price indications, as will be seen, also serve as a player subsidy indication whereby players can be financed during the initial period of play.

Business property cards, not shown in the drawing, are provided for use as an indicia of ownership for each of the player identified and non-identified properties. There is one printed business identification card for each business property and this card is turned over to the player who acquires that business. Preferrably, each card has imprinted thereon a description of the business plus instructions as to how much the player who acquires that business can charge for services when an opponent player chances to land on the play space representing that business. For further identification each business identification card will also be color coded according to the color code in the play space representing the business.

Play spaces representing business properties are grouped generally by color code and in the case of player identified businesses, as above mentioned, by the fictitious name of the player. The number of businesses owned by a single player within each business group will determine the amount of the service charge that player can charge as against opponent players. Preferrably, the following business property groupings and service charge formulas are provided with respect to each business property and are printed on the respective business identification cards:

| GROUP I | |
|---|---|
| Shoeshine Parlor | Pool Hall |
| If one business property is owned collect $5<br>If two business properties are owned collect $10 | If one business property is owned collect $10<br>If two business properties are owned collect $25 |

| GROUP II | | |
|---|---|---|
| Fred's Junkyard | Fred's Auto Parts | Fred's Junkyard |
| If one business property is owned collect $25<br>If two business properties are owned collect $50<br>If three business properties are owned collect $75 | If one business property is owned collect $50<br>If two business properties are owned collect $75<br>If three business properties are owned collect $100 | If one business property is owned collect $25<br>If two business properties are owned collect $50<br>If three business properties are owned collect $75 |

| GROUP III | | |
|---|---|---|
| Uptown Motel | Downtown Hotel | Regent Hot L |
| If one business property is owned collect $25<br>If two business properties are owned collect $50<br>If three business properties are owned collect $75 | If one business property is owned collect $50<br>If two business properties are owned collect $75<br>If three business properties are owned collect $100 | If one business property is owned collect $75<br>If two business properties are owned collect $100<br>If three business properties are owned collect $200 |

| GROUP IV | | |
|---|---|---|
| George's Cleaners | George's Laundromat | George's Tailor Shop |
| If one business property is owned collect $10<br>If two business properties are owned collect $20<br>If three business properties are owned collect $30 | If one business property is owned collect $25<br>If two business properties are owned collect $50<br>If three business properties are owned collect $75 | If one business property is owned collect $100<br>If two business properties are owned collect $200<br>If three business properties are owned collect $300 |

| GROUP V | | |
|---|---|---|
| Bar-B-Q Palace | Soul Kitchen | Steak House |
| If one business | If one business | If one business |

-continued

| | | |
|---|---|---|
| property is owned collect $10 If two business properties are owned collect $25 If three business properties are owned collect $50 | property is owned collect $15 If two business properties are owned collect $45 If three business properties are owned collect $75 | property is owned collect $50 If two business properties are owned collect $75 If three business properties are owned collect $100 |

GROUP VI

| Clifton's Barber Shop | Clifton's Beauty Shop | Clifton's Massage Parlor |
|---|---|---|
| If one business property is owned collect $5 If two business properties are owned collect $10 If three business properties are owned collect $25 | If one business property is owned collect $10 If two business properties are owned collect $20 If three business properties are owned collect $30 | If one business property is owned collect $25 If two business properties are owned collect $50 If three business properties are owned collect $100 |

GROUP VII

| Record Shop | VIP Lounge |
|---|---|
| If one business property is owned collect $5 If two business properties are owned collect $10 | If one business property is owned collect $25 If two business properties are owned collect $50 |

GROUP VIII

| James' Garage | James' Car Wash | James' Service Station |
|---|---|---|
| If one business property is owned collect $100 If two business properties are owned collect $200 If three business properties are owned collect $300 | If one business property is owned collect $5 If two business properties are owned collect $10 If three business properties are owned collect $25 | If one business property is owned collect $10 If two business properties are owned collect $25 If three business properties are owned collect $50 |

GROUP IX

| Finance Company | Pawn Shop |
|---|---|
| If one business property is owned collect 5 times the roll of dice If two business properties are owned collect 10 times roll of dice | If one business property is owned collect 5 times the roll of dice If two business properties are owned collect 10 times roll of dice |

GROUP X

| Great Supermarket | J and J Supermarket |
|---|---|
| If one business property is owned collect $100 If two business properties are owned collect $200 If three business properties are owned collect $300 If four business properties are owned collect $400 | If one business property is owned collect $100 If two business properties are owned collect $200 If three business properties are owned collect $300 If four business properties are owned collect $400 |
| **A and C Supermarket** | **Giant Supermarket** |
| If one business property is owned collect $100 If two business properties are owned collect $200 If three business properties are owned collect $300 If four business properties are owned collect $400 | If one business property is owned collect $100 If two business properties are owned collect $200 If three business properties are owned collect $300 If four business properties are owned collect $400 |

It can be seen from the above that groups II, IV, VI and VIII represent player identified properties, or in other words, only the identified player is permitted to acquire any one of these particular groups. On the other hand, groups I, III, V, VII, IX and X represent non-identified business properties which can be acquired by any player of the game at the price imprinted on the play spaces representing those properties. It is particularly noted, that group IX and X are not physically grouped in close proximity to one another, but are distributed about the play field, and that the formula for determining the service charge with respect to the business properties of group nine differs in approach from the other groups.

Additional play spaced are provided along the four streets of the play field which are not subject to acquisition by the individual players, but which provide certain chance benefits or detriments should the player chance to land on one of these play spaces. Referring to the game board illustrated in the FIGURE, these play spaces are designated Race Track or Social Service Department and a corresponding box labelled Social Service Department and Race Track is imprinted on the interior of the game board, as shown, outside of the play field. A plurality of social service drawings cards, not shown, with either benefit or detriment instructions imprinted thereon are provided for placement within the social service department box on the game board. Likewise, a plurality of Race Track drawing cards, not shown, having either benefit or detriment instructions imprinted thereon are provided for placement within the Race Track box. If a player chances to land on either of the play spaces designated Social Service Department or Race Track, that player is directed to the respective box at the interior of the game board whereupon he draws the top card in that box and follows the instructions imprinted thereon. Preferrably, Social Service Department cards are provided having the following instructions:

| | | |
|---|---|---|
| Your Social Service check is ready. Collect $150 | Visit Archie's House. Pay $50 | Pay Social Services $150 |
| IRS Tax Refund Collect $100 | Social Service No check | No bail (for getting out of jail free) |
| Visit Archie's House. Pay $25 | Cost of businesses up. Pay $100 for each business owned | Receive two checks. Collect $300 |
| Visit Archie's House. Collect previous payments to Archie | Go to Pawn Shop Pay two times the amount on dice to owner | Cost of businesses up. Pay $50 for each business owned |
| Go to Finance Co. Pay two times the amount on dice to owner | | |

And preferrably, the Race Track drawings cards direct the player to pay or collect according to the following instructions:

| | | |
|---|---|---|
| 2 times amount on dice to win | 4 times amount on dice to win | 6 times amount on dice to win |
| 8 times amount on dice to win | 10 times amount on dice to win | 12 times amount on dice to win |
| 14 times amount on dice to win | 16 times amount on dice to win | 18 times amount on dice to win |
| 20 times amount on dice to win | 2 times amount on dice to lose | 4 times amount on dice to lose |
| 6 times amount on dice to lose | 8 times amount on dice to lose | 10 times amount on dice to lose |
| 12 times amount on dice to lose | 14 times amount on dice to lose | 16 times amount on dice to lose |
| 18 times amount on dice to lose | 20 times amount on dice to lose | |

If the player "wins", he collects from the bank; if he "loses" he pays the bank.

The board game of the present invention is played in accordance with the following rules:

The four personal identification cards are shuffled and placed face down whereupon each player picks a card for determining his identification throughout the game. Each player then throws the dice and the player with the highest total will have the first play. No player is given money at the start of the game.

To begin the game, the player tokens are placed in the corner square 19 which is designated ghetto. Following in turn, each player rolls the dice to determine in the customary fashion how many play spaces on the play field which he should advance his token. On the first time around the board each player will received, as a subsidy from the bank, one-half the price of any property with a selling price on which the player may land. No player may purchase or acquire a business property nor shall he be assessed penalties on the first time around the board. Each time a player completes a course around the board and passes corner square 19 designated ghetto, that player shall received from the bank a $150 salary.

After the first time around the board, a player may buy any business property having an acquisition price. Once he has purchased this property the player may charge opponent players a service fee should an opponent player occupy that business property in accordance with the roll of the dice.

If a player lands on a business property which is identified by the fictitious name assigned to him, that identified player shall take ownership of the property without payment, and shall be entitled to charge other players a service fee when and if an opponent player chances to land on the identified business property. It should be carefully noted that only one of the players of the game is entitled to acquire any particular player identified business property, and that that identified player is not entitled to charge a service fee as against opponent players until he lands on and thereby acquires his identified business.

A player who occupies Archie's place, corner square 23, shall normally be entitled to rest there without penalty or benefit. However, a player is subject to being directed to Archie's Place by instructions on certain Social Service cards and to pay to Archie either $25 or $50. Preferrably, these payments should be placed under the corner of the board representing Archie's Place. Certain other Social Service cards may direct a player to Archie's Place with instructions to collect all monies previously paid and thus accumulated under that corner of the board.

It the player occupies a play space designated Social Service Department or Race Track, he must draw the top card from the appropriate Social Service Department or Race Track card pile and follow the instructions printed thereon.

If a player lands on the play space designated IRS Audit he must pay $100 to the bank.

A player is in jail if he lands on and occupies either of corner square 21 or 25 designated Jail No. 1 and Jail No. 2, respectively. A player cannot continue play until he gets out of jail. To get out of Jail No. 1 a player must pay $25 or lose one turn or have a no bail card previously drawn from the Social Service Department. To get out of Jail No. 2 a player must pay $50 to lose two turns or have a no bail card.

If a player cannot pay a service charge charged by an opponent player, all properties which he owns must be turned over to the player that is owed. That player is then out of the game and back in the "ghetto".

The present invention provides a board game which utilizes designated owner operated business properties which can be identified with an inner city urban environment. The game is exciting to play and embraces contemporary places, businesses and social situations and can be participated in by most age groups.

Although the board game of the present invention has been described in considerable detail in the above specification, it is not intended that the invention be limited to such detail, except as necessitated by the appended claims.

I claim:

1. A board game utilizing owner operated businesses wherein players strive by chance to maximize their financial worth comprising means for identifying each player by a fictitious name prior to commencing play, tokens for each identified player, bogus money which can be used for acquiring said businesses or paying for services or the like, a game board having a plurality of contiguous play spaces disposed generally around the perimeter of said board so as to define a continuous play field on which said tokens can be moved, certain of said play spaces in said play field designating different business each of which is identified to a particular player by said fictitious name and subject to acquisition and operation by the player so identified as against opponent players, and certain of said play spaces in said play field designating different businesses not identified to any particular player and subject to acquisition and operation by any of said players as against opponent players, said player identified business property being capable of acquisition by the identified player at no cost to him if he chances to land on the play space so designating said business property, and said non-identified businesses being capable of acquisition at a predetermined purchase price by any of the players who chances to land on the play space so designating said business property, and a chance means for advancing said player tokens around the play field on said game board.

2. The board game of claim 1 wherein said game board is substantially square and said player-identified businesses are grouped according to the identified player on respective sides of the game board.

3. The board game of claim 1 wherein the play spaces representing said non-identified business properties have acquisition price indications printed thereon designating the price which the player who chances to land on such play space must pay in order to acquire said business for operation against opponent players, said acquisition price indications also serving as player subsidy indication means for financing players by chance during an initial period of play.

4. The board game of claim 2 wherein each side of said square play field is designated by a street name.

5. A board game utilizing owner operated businesses wherein players strive by chance to maximize their financial worth comprising means for identifying each player by a fictitious namer prior to commencing play, tokens for each identified player, bogus money which can be used for acquiring businesses or pay for services, or the like a substantially square game board having a plurality of contiguous play spaces disposed around the perimeter of said board so as to define a continuous play field on which said tokens can be moved, certain of said play spaces in said play field designating different businesses each of which is identified to a particular player by said fictitious name and subject to acquisition and operation by the player so identified as against opponent players, said play spaces representing said player-identified businesses being grouped according to the identified player on separate side of the game board and being capable of acquisition by the identified player at no cost to him if he chances to land on the play space so designating said business, and certain of said play spaces in said play field designating different businesses not identified to any particular player and subject to acquisition and operation by any of said players as against opponent players, the play spaces representing said non-identified businesses being spaced around the play field between said player-identified property and having acquisition cost indicators printed thereon designating the price which the player who chances to land on such play space must pay in order to acquire said business property for operation against opponent players, said acquisition price indications also serving as a player subsidy indication means for financing players by chance during an initial period of play, and a chance means for advancing said player tokens around the play field of said game board.

* * * * *